US005390805A

United States Patent [19]

Bilani et al.

[11] Patent Number: 5,390,805

[45] Date of Patent: Feb. 21, 1995

[54] SYSTEM COMPRISING A CONTAINER HAVING A SLIT VALVE AS A VENTING VALVE AND A LIQUID CONTAINED IN SAID CONTAINER

[75] Inventors: Nadi Bilani, Strombeek-Bever; Johan W. Declerck, Ichtegem; Jorgen Hoernaert, Brugge, all of Belgium

[73] Assignee: The Procter & Gamble Company, Cincinnati, Ohio

[21] Appl. No.: 16,412

[22] Filed: Feb. 11, 1993

[51] Int. Cl.[6] ..... B65D 51/16

[52] U.S. Cl. ..... 215/260; 220/367; 222/490; 222/556; 222/562; 137/845

[58] Field of Search ..... 215/260, 307, 310; 220/367, 368; 222/212, 214, 490, 494, 545, 546, 556, 562; 137/845

[56] References Cited

U.S. PATENT DOCUMENTS

| | | | |
|---|---|---|---|
| 2,162,455 | 6/1939 | Hoge | 215/56 |
| 2,254,815 | 9/1941 | Barnby et al. | 215/56 |
| 4,341,239 | 7/1982 | Atkinson | 137/493 |
| 4,749,108 | 6/1988 | Dornbusch et al. | 222/212 |
| 5,143,236 | 9/1992 | Gueret | 215/311 |

FOREIGN PATENT DOCUMENTS

| | | |
|---|---|---|
| 160336 | 11/1985 | European Pat. Off. . |
| 278125 | 8/1988 | European Pat. Off. . |
| 412390 | 2/1991 | European Pat. Off. . |
| 442379 | 8/1991 | European Pat. Off. . |
| 462861 | 12/1991 | European Pat. Off. . |
| 3318923 | 1/1985 | Germany . |

*Primary Examiner*—Allan N. Shoap
*Assistant Examiner*—Nova Stucker
*Attorney, Agent, or Firm*—Dean L. Garner

[57] ABSTRACT

In a system comprising a container and a liquid contained therein that builds up a gas or vapor pressure, a sealing valve having a concave shaped portion and a slit extending through said portion, allows venting of the vapor from the container to the ambient at a predetermined vapor threshold pressure. The vapor threshold pressure at which the slit opens for venting can be adjusted by valve restraining means which are preferably formed by a protrusion at the inside of a cap covering the sealing valve. The vapor threshold pressure at which venting takes place, can to a large extent be adjusted without affecting the dispensing characteristics of the valve.

4 Claims, 5 Drawing Sheets

SYSTEM COMPRISING A CONTAINER HAVING A SLIT VALVE AS A VENTING VALVE AND A LIQUID CONTAINED IN SAID CONTAINER

FIELD OF THE INVENTION

The invention relates to system comprising a container and a liquid contained therein, the container comprising a discharge orifice, a sealing valve covering the discharge orifice, the sealing valve comprising a flexible concave top portion which is curved towards the discharge orifice and which is provided with at least one slit extending from a surface of the top portion facing the discharge orifice, to a surface of the top portion located away from the discharge orifice, the slit being openable when a pressure at the sealing valve exceeds a dispensing threshold pressure, a cap comprising an outer side wall and a top wall covering the outer side wall, the cap in a storage mode of the container covering the sealing valve, the cap comprising valve restraining means preventing the top portion from inverting and being removable from the sealing valve for dispensing of the liquid.

BACKGROUND OF THE INVENTION

Such a system is known from the European patent application EP-A-278 125.

In this patent application a flexible container is described having a sealing valve of relatively flexible material, such as for instance silicone rubber, polyvinyl chloride, urethane, ethylene vinyl acetate or a styre butadiene copolymer. Upon placing the container in an upside-down position and upon application of a squeezing force on the container, the sealing valve opens due to the increased pressure and a dispensing of the liquid through the slit occurs. Upon removal of the squeezing force, the slit closes and the liquid is prevented from flowing out of the container. The stiffness of the sealing valve is sufficient to prevent the slit from opening under the hydrostatic pressure of the liquid when the container is placed in an inverted position. To prevent opening of the slit during storage or transportation of the container, due to unintentionally applied squeezing forces or shocks due to falling, the sealing valve is covered by a cap having valve restraining means which prevent the concave top portion of the sealing valve from inverting. The valve restraining means comprises a first annular rim at the inside of the cap, which annular rim is adjacent to the concave top portion, and a second annular rim which is concentric with the first annular rim, which rests on the flexible sidewall portion of the sealing valve and which exerts a radially directed compressive force on the sealing valve keeping the slit closed. To allow passage of air that, upon unintentional compression of the container, is trapped inside the annular rims of the valve restraining means, to the ambient, the rims are provided with venting slots. Hereby dislodging of the valve restraining means is prevented upon sudden and unintentional compression of the container.

It is an object of the invention to provide for a system comprising a container and a liquid contained therein, the container allowing for accurate dispensing and for sealingly storing of its contents.

It is another object of the invention to provide for a system comprising a container and a liquid contained therein, in which the container has means for reducing the pressure inside the container under various storing and transportation conditions.

It is again another object of the invention to provide for a container that can be of a non-cylindrical shape.

A system according to the invention is characterized in that in the storage mode, the liquid contained in the container can build up a predetermined gas or vapour pressure, the container being in the storage mode in an upright position so that vapour in the container can contact the sealing valve, the valve restraining means allowing opening of the top portion's slit when the force exerted by the gas or vapour on the sealing valve exceeds a vapour threshold pressure.

Especially for products that build up a vapour pressure, or products that release a gas due to decomposition, such as for instance household bleaches or products containing peroxides, hypochlorides or perborates, the properties of the sealing valve can be used, not only for accurate and dripless dispensing, but also for venting of the gas or vapour to the ambient. During storage, the gas or vapour pressure can rise to between 30 and 150 mbar over the ambient pressure. Especially for flexible containers of non-cylindrical shape, this will give rise to serious bulging if no venting takes place.

By adjusting the length of the slit, the flexibility of the concave top portion of the sealing valve and the distance of the valve restraining means from the concave top portion, the vapour threshold pressure at which the slit slightly opens for venting, can be set to a desired value. So can for instance the flexibility of the sealing valve and the length of the slit be selected to give a good dispensing for a liquid having a predetermined viscosity, the vapour threshold pressure at which venting occurs during storage, being adjustable through variation of the valve restraining means. Contrary to the container that is disclosed in the European patent application EP-A-278125, it is essential for the container in the system according to the invention, to be in its upright position during storage. Hereby the sealing valve is located in the higher part of the container and the vapour will be in contact with the interior face of the sealing valve's concave top portion, thus allowing venting.

An embodiment of the system according to the invention is characterized in that the valve restraining means are formed by a protrusion extending from an interior face of the top wall towards the concave top portion of the sealing valve for adjustment of the vapour threshold pressure.

By selectively restricting the movement of a part of the concave top portion of the sealing valve upon closure of the cap, the vapour threshold pressure at which opening of the slit occurs can be lowered. In the dispensing mode, the cap is removed from the sealing valve so that the slit will open at the dispensing threshold pressure, which is to a large extent independent of the vapour threshold pressure.

In an embodiment of a system according to the invention, the protrusion comprises an interior wall, a projection of which on the concave top portion encircles the slit, the interior wall comprising a lower edge which is located above the top portion so that upon a rise of pressure in the container the interior wall and the concave top portion enclose a venting chamber. Upon increase of the pressure inside the container, the valve's concave top portion is pressed against the lower edge of the interior wall. The slit is confined within the venting chamber that is enclosed by the interior wall and the concave top portion. When the pressure in the bottle reaches the vapour threshold pressure, the slit will open and an amount of vapour is transferred into the venting chamber. Due to the resulting pressure equalisation in the container and the venting chamber, the slit closes and the concave top portion will retract so that the air entrapped in the venting chamber can vent to the ambient. By varying the diameter of the venting chamber and the distance between the lower edge of the interior wall and the concave top portion, the vapour threshold pressure can be adjusted. If desired, it is possible to adjust the vapour threshold pressure to a value which is higher than the dispensing threshold pressure by giving the venting chamber a sufficiently small diameter and placing the lower edge of the interior wall close to the concave top portion of the sealing valve.

In an embodiment of a system according to the invention, the cap has a spacing member connected to the interior face of the top wall which spacing member, in the closed position of the cap, rests on a blocking surface for restriction of movement of the valve restraining means towards the concave top portion. Hereby the position of the cap is always accurately defined with respect to the sealing valve and it is prevented that the slit is opened by pressing the cap down too far over the sealing valve.

Some embodiments of a system according to the invention will be discussed in detail with reference to the accompanying drawings.

DETAILED DESCRIPTION OF THE INVENTION

Figure 1:
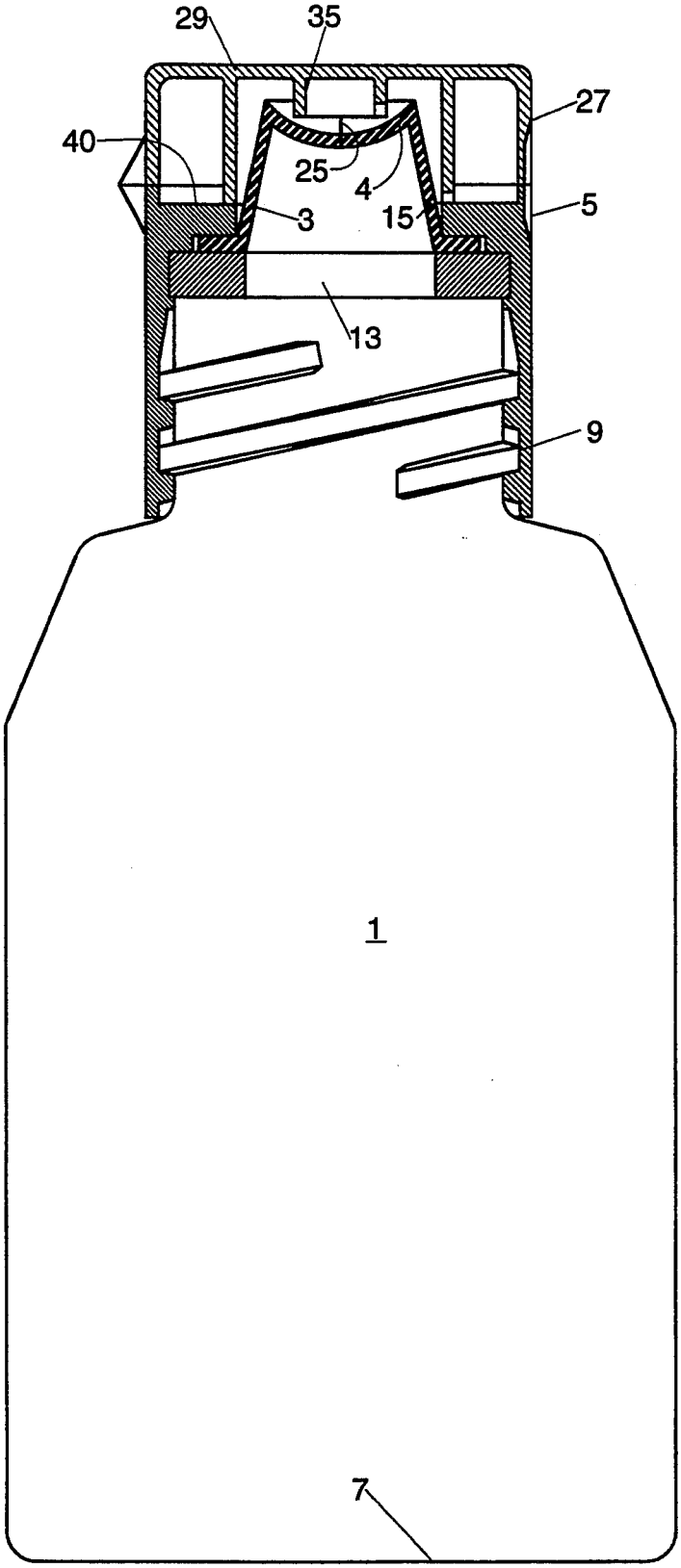
FIG. 1 shows a partial cross section of a container having a sealing valve and a cap.

FIG. 1 shows a flexible container 1 such as a blow moulded plastic bottle comprised of any of several materials such as polypropylene, polyethylene, polyvinylchloride and the like. The particular material of construction chosen for any given application will, in general, be determined by factors such as product compatibility, cost, permeability and the like. The container can also be formed of a non-flexible thermoplastic material or of a metal. For flexible containers the critical parameter is that the resiliently deformable container 1 exhibits a degree of flexibility sufficient to permit manual deformation of the container to extrude product through a sealing valve 3 and a sufficiently strong predisposition to return to its undeformed condition when external forces are removed that it will create a substantially instantaneous pressure drop inside the container, thereby assisting closure of the sealing valve 3 in use. The sealing valve 3 is covered by a cap 5, which during storage of the container 1, prevents inversion of the concave top portion 4 of the sealing valve 3 and keeps the product contained inside the container 1 sealed from the ambient and leakfree during transportations.

For a number of liquids, storing inside a flexible container which is sealed by a cap, causes problems due to the liquids releasing a gas or having a relatively high vapour pressure. The pressure build-up inside the container can lead to deformation thereof and can cause the container to become unstable due to bulging of the container's base, and can cause the container to topple over In a test set-up a sealed 1 l bottle of 1% hypochloride solution having a 10% head-space was stored at 50° C. The measured pressure build-up was 120 mbar after 3 days of storage and 150 mbar after 6 days of storage. For conditions under which such gas or vapour pressures prevail, use of a sealing valve as shown in FIG. 2 allows for venting of the gas or vapour when the pressure inside the container 1 reaches a predetermined vapour threshold pressure, which can be selected to be between 10 mbar and 500 mbar preferably between 40 and 150 mbar, above the ambient pressure.

Figure 2:
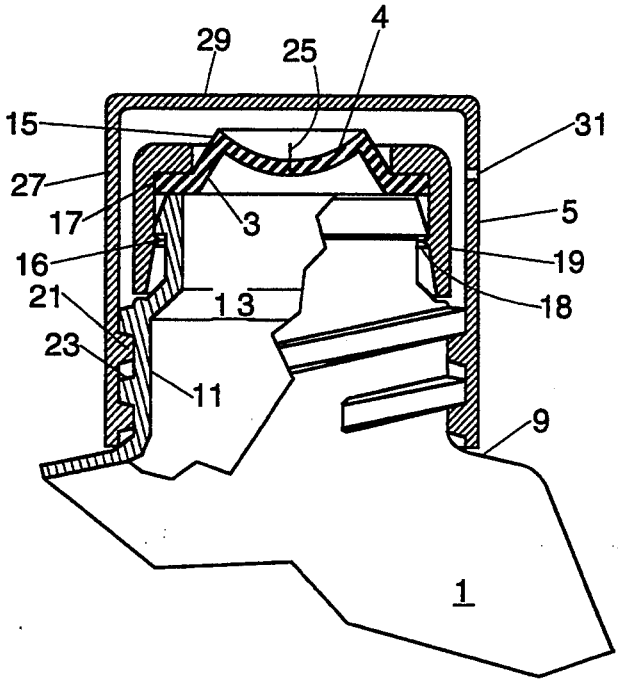
FIG. 2 shows a cross section of the sealing valve and the cap wherein the valve restraining means are formed by a top wall of the cap.

FIG. 2 shows a neck portion 9 of the container 1 having a wall 11 enclosing a discharge orifice 13 of the container. The discharge orifice 13 is covered by the sealing valve 3 that comprises the concave top portion 4 and a flexible annular sidewall portion 15. Connected to the annular sidewall portion 15 is a flange 17 resting on the upper edge of the wall 11 of neck portion 9. The sealing valve 3, which is preferably made of different, more flexible material than the container 1, such as silicone rubber, polyvinyl chloride, urethane, ethylene vinyl acetate, styrene butadiene copolymers and the like, is sealingly clamped to the neck portion 9 by a fixing ring 19 that has a snap-on edge 16, flexibly engaging an outer circumferential groove 18 of the wall 11.

Figure 3A:
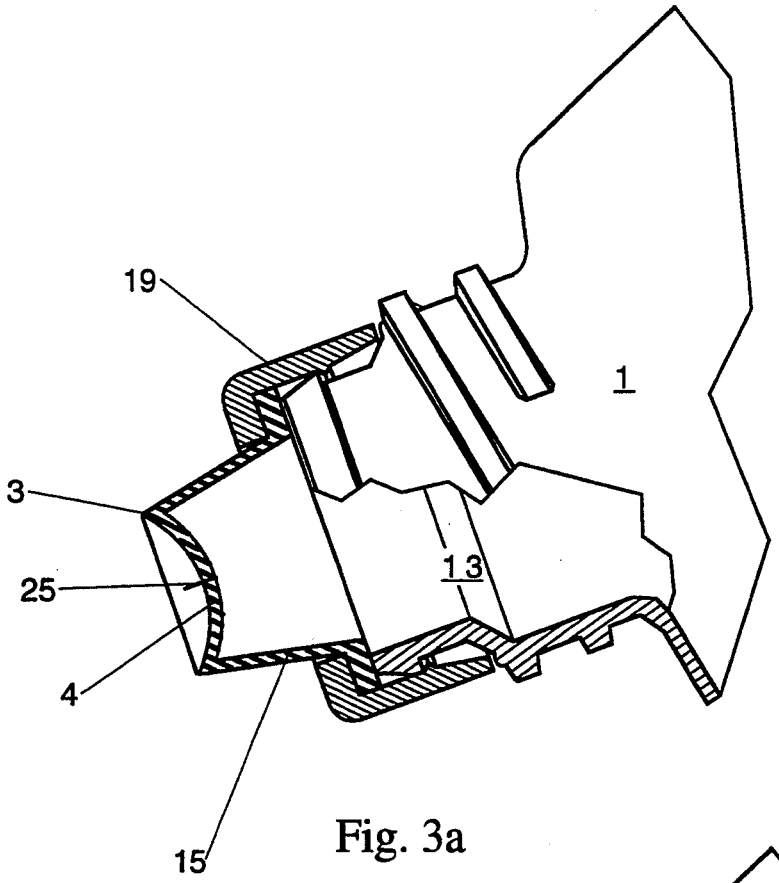
FIG. 3*a* and 3*b* show a cross section of the sealing valve upon product dispensing.
Figure 3B:
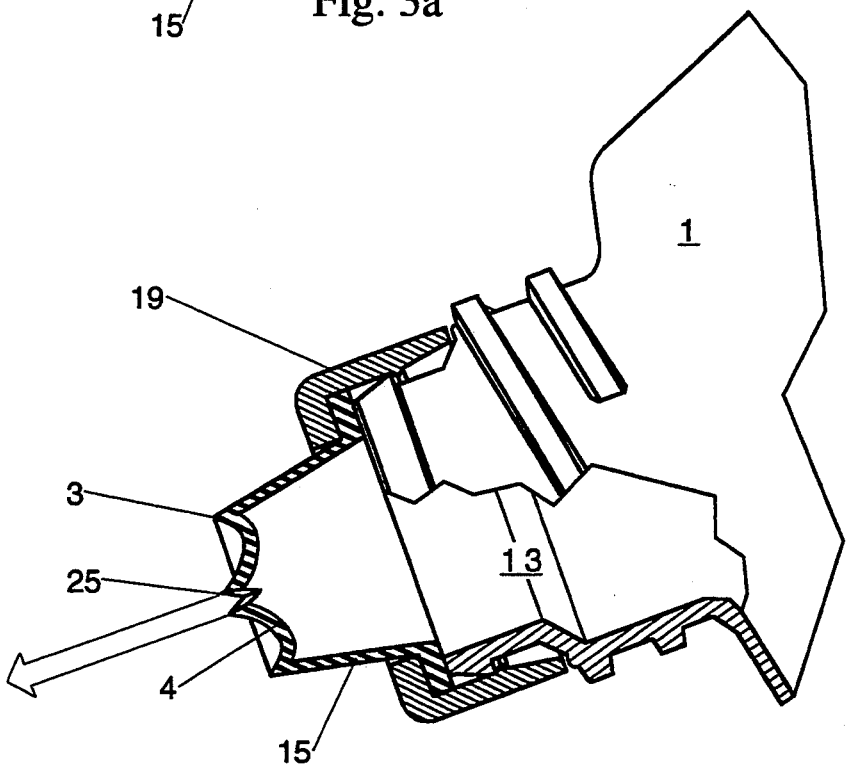

A linear slit 25 extends through the width of the concave top portion 4 and is pressed closed when the concave shaped top portion 4 is in its inwardly concave position. Upon application of a compressive force to the sides of the flexible container 1, the pressure inside the container will rise and, in absence of the cap 5, the concave shaped top portion 4 buckles outward so that the slit 25 is opened and product can be dispensed from the container 1. Upon dispensing of the container's contents, the container is held in an upside down position, as shown in FIG. 3*a*. The slit 25 is opened when the combination of the hydraulic head pressure, due to the liquid resting on the concave top portion 4, and the pressure exerted by the user when subjecting the container 1 to compressive forces, reaches the dispensing threshold pressure as shown in FIG. 3*b*. When after product dispensing, which can be directed and drip-free, the compressive forces are removed from the container, the slit 25 closes and air is sucked back into the container until the pressure inside the container equals ambient pressure and the container 1 has taken back its undeformed shape. Depending upon the dispensing characteristics that are desired, such as a fine or a large jet of liquid or precise dispensing of small quantities of product, the length of the slit and the number of slits used can be selected.

In case more than 1 slit is present in the concave top portion 25, the dispensing characteristics can be varied by adjustment of the configuration of the slits, which can be parallel, radial or intersecting. In the European patent application EP-A-160 336, which is hereby incorporated by reference, a theoretical explanation of the functioning of the sealing valve 3 is given.

To prevent the sealing valve 3 from opening during storage and transportation of the container 1, the sealing valve 3 is covered by a cap 5 comprising an outer side wall 27, which in this example is cylindrical, but which can have any general shape such as oval, square or triangular, and a top wall 29, as shown in FIG. 2. The top wall 29 is in this embodiment placed at such a distance from the concave shaped top portion 4 of the sealing valve, that inversion of the top portion 4 is prevented and no product discharge is possible. For containers comprising liquids which evaporate when stored, the cap 5 must be shaped so that the distance between the top wall 29 and the sealing valve 3 is large enough to allow widening of the slit 25 due to the pressure build-up inside the container and to allow venting of vapour from the container into the space enclosed by the cap 5 and the sealing valve 3. To aid venting of the vapour from the interior of the cap 5 to the ambient, the cap 5 can be provided with a venting hole 31. A venting hole 31 can be omitted in case the cap 5 is secured to the container's neck portion 9 in a non-sealing manner.

Figure 4:
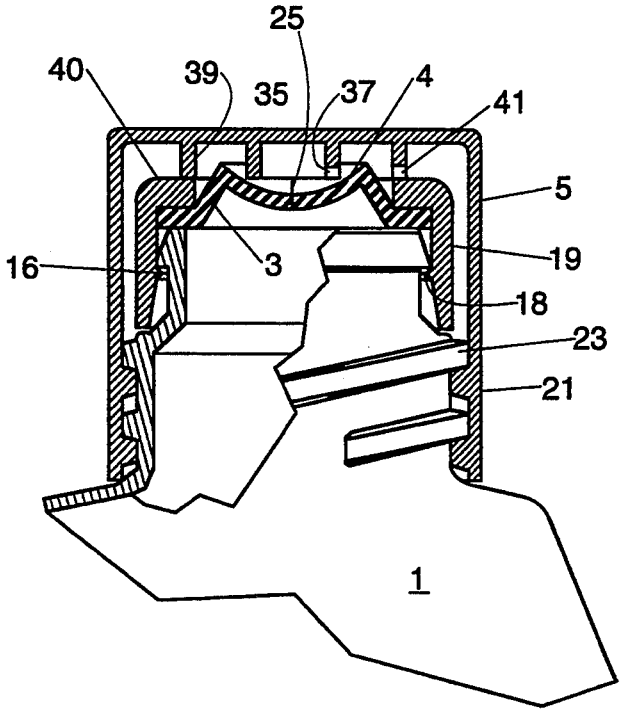
FIG. 4 shows a cross section of a sealing valve and cap according to the invention wherein the valve restraining means are formed by a protrusion on the inside of the cap.
Figure 5:
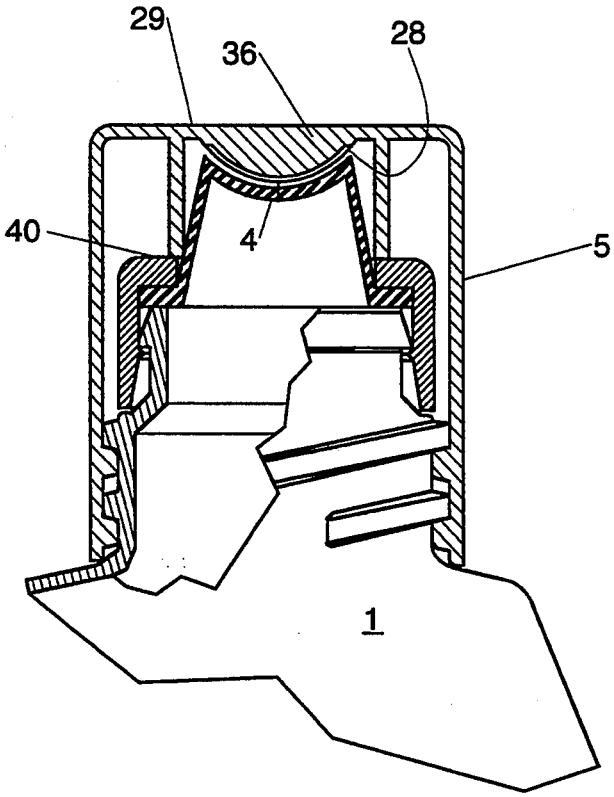
FIG. 5 shows a cross-section of an embodiment of a sealing valve and cap according to the invention wherein the valve restraining means comprise a dome-shaped protrusion.
Figure 7A:
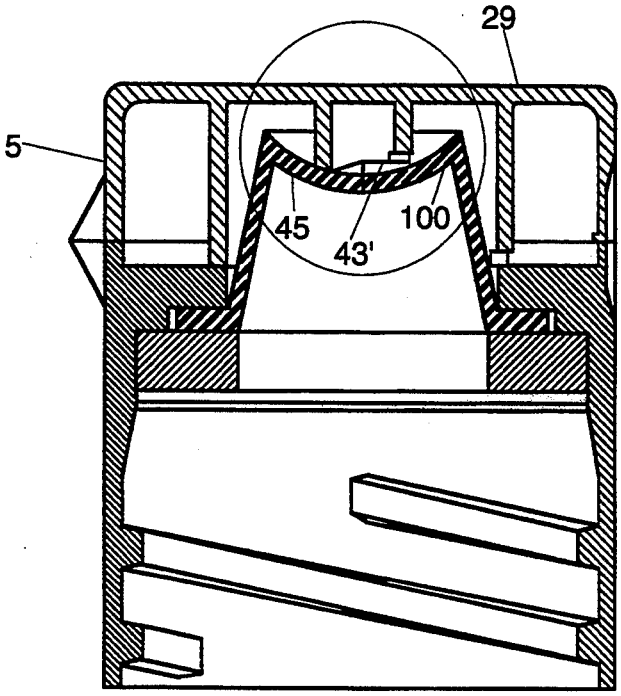
FIG. 7*a* and 7*b* show a cross sectional view of an embodiment of the valve restraining means according to the invention and an enlarged detail thereof.
Figure 7B:
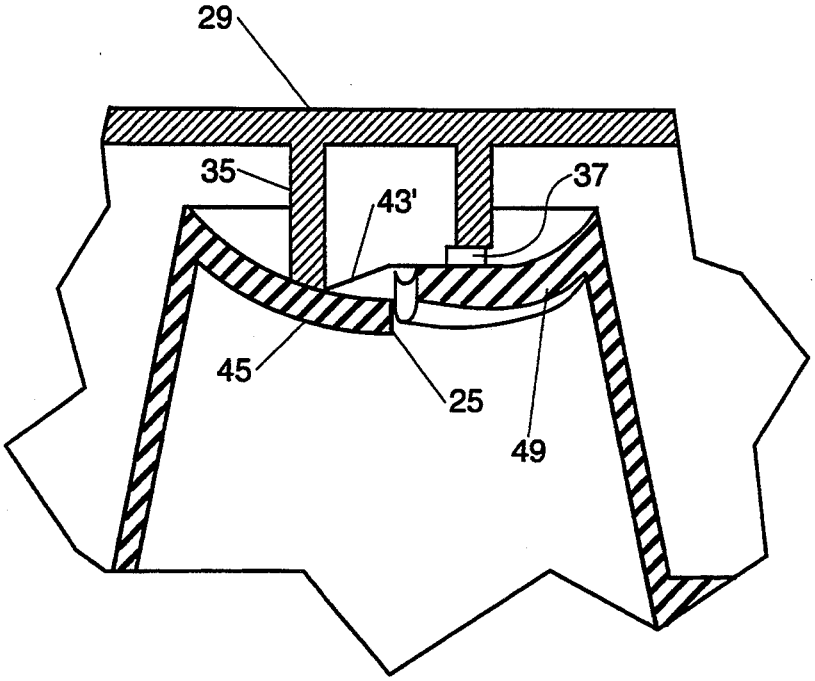

The cap 5 can be provided with an internal screw thread 21 that engages a complemtary screw thread 23 on the outside of wall 11 of the neck portion of the container and can be completely removed from the container as is shown in FIGS. 2, 4, and 5. The cap can also be a flip-top cap which remains attached to the container during dispensing, as is shown in FIGS. 1, 7*a* and 7*b*. It is of course possible to attach the cap 5 to the container's neck portion by other well known means, such as for instance a snap joint.

In case the cap 5 is secured to the container's neck portion 9 by a snap joint which is relatively fluid-tight the presence of a venting hole 31 is necessary.

FIG. 4 shows an embodiment in which the cap 5 is at its inside provided with valve restraining means which comprise a protrusion 35 extending toward the concave shaped top portion 4. The protrusion 35 prevents product dispensing from the container by restricting the movement of concave shaped top portion 4 to such an extent that only a very slight opening of the slit 25 is allowed. When the pressure inside the container reaches the vapour threshold pressure, the concave shaped top portion 4 is pressed against the ring-shaped protrusion 35 and vapour passes through the slightly opened slit 25 from the interior of the container to the space between the ring-shaped protrusion 35 and the concave top portion 4. By a notch 37 in the lower part of the protrusion 35, a venting channel is formed by which vapour can pass in a radial direction towards the screw threads 21, 23 of the cap 3 via which the vapour can pass into the ambient. To clearly define the distance between the lower edge of the protrusion 35 and the concave top portion 4, which determines the vapour threshold pressure at which venting takes place, the cap 3 is provided with an annular spacing member 39 which rests on a top surface 40 of the fixing ring 19. The lower edge of the spacing member is provided with a notch 41 for allowing vapour to pass between the spacing member 39 and the fixing ring 19.

FIG. 5 shows an alternative embodiment in which the protrusion is dome-shaped, the surface of the protrusion being complementary to the concave top portion 4. The protrusion is adjacent to substantially the whole of the concave for portion 4, which results in a high resistance of the sealing valve 3 to opening due to inadvertent high impacts on the container 1 during storing and transportation. To prevent sealing of the slit 25 by the dome-shaped protrusion, the dome-shaped protrusion is provided with a channel 28 which extends perpendicular to the slit 25.

Figure 6:
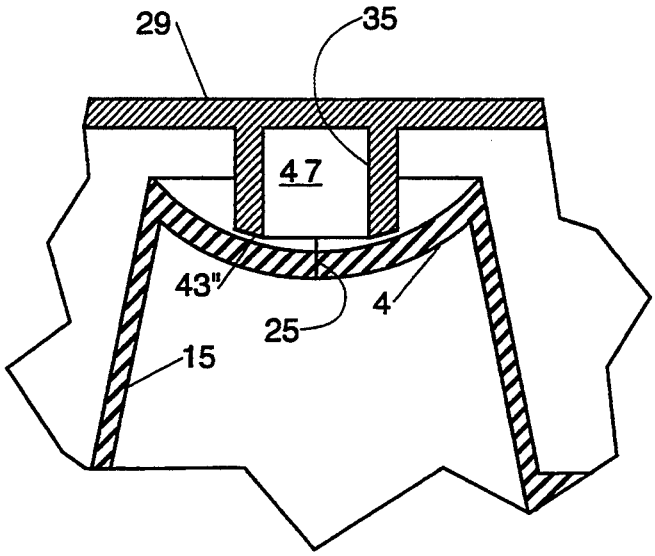
FIG. 6 shows an enlarged cross sectional view of the valve restraining means according to the invention and an enlarged detail thereof.

FIG. 6 show an embodiment in which the annular protrusion 35 has a lower edge 43" which has in a circumferential direction of the protrusion 35, a constant distance to the concave portion 4. Upon a rise in pressure in the container, the concave portion 4 will be pressed upward against the lower edge 43" so that a venting chamber 47 is enclosed by the protrusion 35 and the concave portion 4. Upon a further increase of the internal pressure of the container, the slit 25 will open and vapour will pass from the container into the venting chamber 47. The resulting pressure equalisation in the container and the venting chamber, will cause the slit 25 to close and the concave portion 4 to resume its inwardly concave position. The gas or vapour entrapped in the venting chamber can pass between the lower edge 43" and the concave portion to the ambient. By changing the diameter of the venting chamber and the distance between the protrusion 35 and the concave top portion 4, the vapour threshold pressure at which the slit 25 opens can be adjusted to be higher than the dispensing threshold pressure for a sealing valve having predetermined dispensing characteristics.

FIGS. 7*a* and 7*b* show an embodiment in which the protrusion 35 comprises a lower edge 43' which is contacting the upper surface of the concave portion 4 for a first part 45 of the slit valve that is located on one side of the slit 25, and which is located at a certain distance from the upper surface of the concave portion 4 for a part of the concave portion 4 located at the other side of slit 25. When the internal pressure of the container increases, the part 100 of the concave portion 4 is pressed upward against the lower edge 43', the part 100 of the concave portion 4 being held in place by the lower edge. This is illustrated in FIG. 7. Due to the non-uniform deformation of the concave portion of the sealing valve 3 upon an increase in pressure, the vapour threshold pressure at which the slit 25 opens will be different from the dispensing threshold pressure. By adjusting the radius, d1, of the ring-shaped protrusion 35 and the distance from the lower edge 43' to the concave top portion 4, the vapour threshold pressure can be controlled to have a specific value, which can be higher or lower than the dispensing threshold pressure, for any sealing valve 3 having predetermined dispensing characteristics.

We claim:

1. System comprising a container (1) and a liquid contained therein, the container comprising:

(a) a discharge orifice (13);

(b) a sealing valve (3) covering the discharge orifice (13), the sealing valve comprising a flexible concave top portion (4) which is curved towards the discharge orifice and which is provided with at least one slit (25) extending from a surface of the top portion facing the discharge orifice, to a surface of the top portion located away from the discharge orifice, the slit being openable when a pressure at the sealing valve exceeds a dispensing threshold pressure; and (c) a cap (5) comprising an outer side wall (27) and a top wall (29) surrounding and attached to the outer side wall, the cap in a storage mode of the container covering the sealing valve, the cap comprising valve restraining means (29,35,36) preventing the top portion from inverting and being removable from the sealing valve for dispensing of the liquid, the valve restraining means defined by a protrusion (35) extending from an interior face of the top wall (29) towards the concave top portion (4) of the sealing valve for adjustment of a vapor threshold pressure, the protrusion has a domed shape having a curved face extending parallel to the concave top portion (4) at a predetermined distance, whereby when the container is in the storage mode, the liquid contained in the container can build up a predetermined gas or vapor pressure, the container being in the storage mode in an upright position so that gas or vapor in the container can contact the sealing valve, the valve restraining means (29,35,36) allowing opening of the top portion's slit when the force exerted by the gas or vapor on the sealing valve, exceeds a vapor threshold pressure.

2. System comprising a container (1) and a liquid contained therein, the container comprising:

(a) a discharge orifice (13);

(b) a sealing valve (3) covering the discharge orifice (13), the sealing valve comprising a flexible concave top portion (4) which is curved towards the discharge orifice and which is provided with at least one slit (25) extending from a surface of the top portion facing the discharge orifice, to a surface of the top portion located away from the discharge orifice, the slit being openable when a pressure at the sealing valve exceeds a dispensing threshold pressure; and (c) a cap (5) comprising an outer side wall (27) and a top wall (29) surrounding and attached to the outer side wall, the cap in a storage mode of the container covering the sealing valve, the cap comprising valve restraining means (29,35,36) preventing the top portion from inverting and being removable from the sealing valve for dispensing of the liquid, the valve restraining means defined by a protrusion (35) extending from interior face of the top wall (29) towards the concave top portion (4) of the sealing valve for adjustment of a vapor threshold pressure, the protrusion (35) has a lower edge (43'), of which a first part is located near the concave top portion (4) on one side of the slit (25) and of which a second part is located near the concave top portion (4) on the other side of the slit (25), the distance between the first part of the lower edge (43') and the concave top portion (4) being different from the distance between the second part of the lower edge and the concave top portion, whereby when the container is in the storage mode, the liquid contained in the container can build up a predetermined gas or vapor pressure, the container being in the storage mode in an upright position so that gas or vapor in the container can contact the sealing valve, the valve restraining means (29,35,36) allowing opening of the top portion's slit when the force exerted by the gas or vapor on the sealing valve, exceeds a vapor threshold pressure.

3. System according to claims 1 or 2, wherein the sealing valve (3) comprises a flange (17) which is connected to an annular sidewall portion (15), the flange (17) being supported by a top part of a neck portion (9) of the container, a fixing ring (19) having a central bore encircling the annular side wall portion (15) of the sealing valve (3), overlying the flange (17), the fixing ring being provided with connecting means (16) engaging complementary connecting means (18) on the containers neck portion (9) for clamping the sealing valve (3) over the discharge orifice (13).

4. System according to claims 1 or 2, wherein the cap (5) has a spacing member (39) connected to the interior face of the top wall (29), which spacing member, in the closed position of the cap, rests on a blocking surface (40) for restriction of movement of the valve restraining means (29, 35, 36) towards the concave top portion.

* * * * *